United States Patent [19]

Ketterer

[11] 4,297,957

[45] Nov. 3, 1981

[54] ANTI-HALOING THROAT PLATE

[75] Inventor: Stanley J. Ketterer, Jamesburg, N.J.

[73] Assignee: The Singer Company, Stamford, Conn.

[21] Appl. No.: 85,458

[22] Filed: Oct. 17, 1979

Related U.S. Application Data

[62] Division of Ser. No. 940,935, Sep. 11, 1978, Pat. No. 4,266,494.

[51] Int. Cl.[3] ..... D05B 57/08; D05B 73/12

[52] U.S. Cl. ..... 112/184; 112/260; 112/302

[58] Field of Search ..... 112/153, 184, 202, 260, 112/302

[56] References Cited

U.S. PATENT DOCUMENTS

| | | | |
|---|---|---|---|
| 1,127,067 | 2/1915 | Moffatt | 112/260 X |
| 1,188,818 | 6/1916 | Parkes | 112/260 X |
| 1,255,970 | 2/1918 | Zaleski | 112/157 X |
| 1,350,931 | 8/1920 | Moffatt et al. | 112/260 |
| 2,219,460 | 10/1940 | Turrisi | 112/179 |
| 2,328,705 | 9/1943 | Becker | 112/302 X |
| 2,350,267 | 5/1944 | Zonis | 112/197 |
| 3,376,839 | 4/1968 | Howard | 112/260 |
| 3,720,178 | 3/1973 | Ivanko | 112/202 X |
| 4,095,539 | 6/1978 | Johnson | 112/184 |

FOREIGN PATENT DOCUMENTS

| | | |
|---|---|---|
| 30-218250 | 12/1955 | Japan . |
| 34-492385 | 4/1959 | Japan . |
| 39-742940 | 7/1964 | Japan . |
| 43-849409 | 6/1968 | Japan . |

*Primary Examiner*—Wm. Carter Reynolds

*Attorney, Agent, or Firm*—James M. Trygg; Robert E. Smith; Edward L. Bell

[57] ABSTRACT

A throat plate having means attached thereto for preventing the work limb in a loop of thread from being drawn up through the material being sewn by the takeup limb due to friction therebetween causing a loose stitch known as a halo.

3 Claims, 11 Drawing Figures

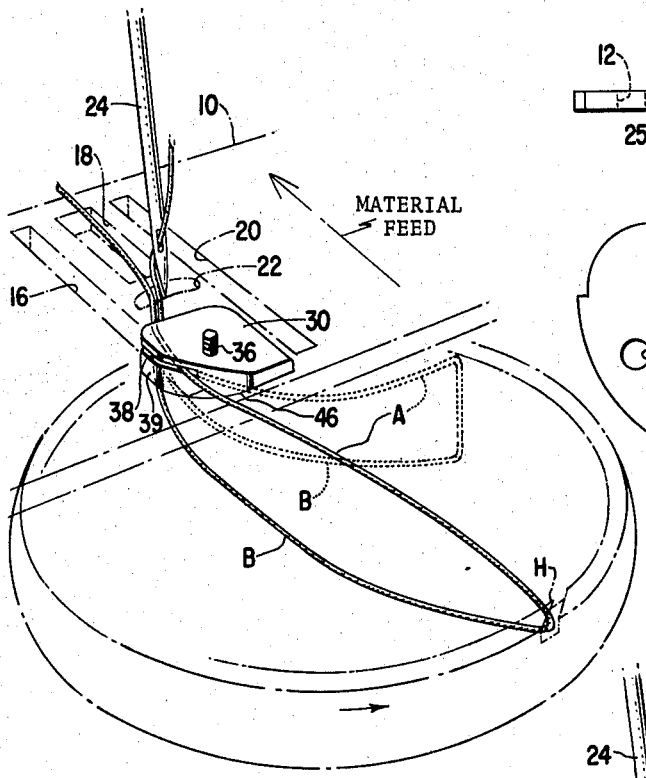
Fig. 3
Fig. 2
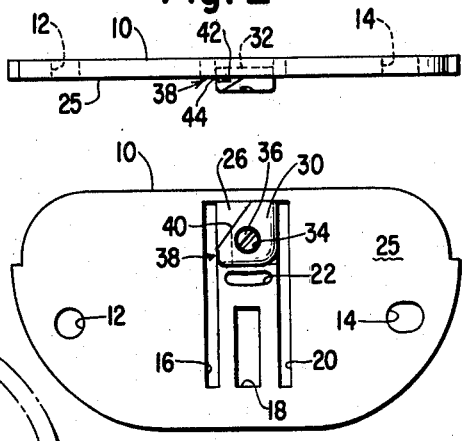
Fig. 1
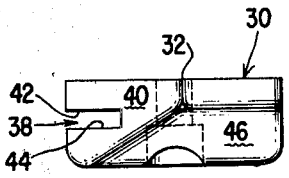
Fig. 6
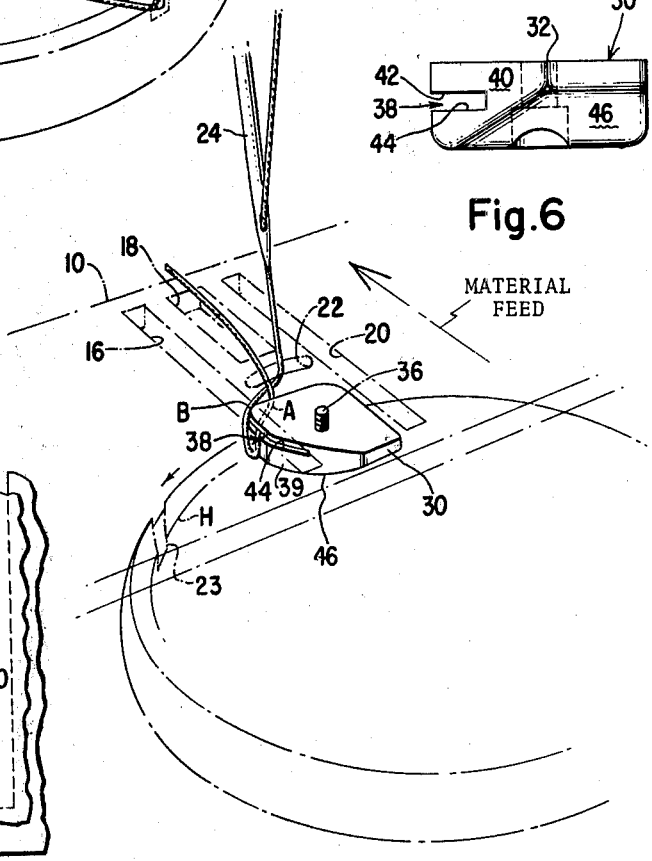
Fig. 4
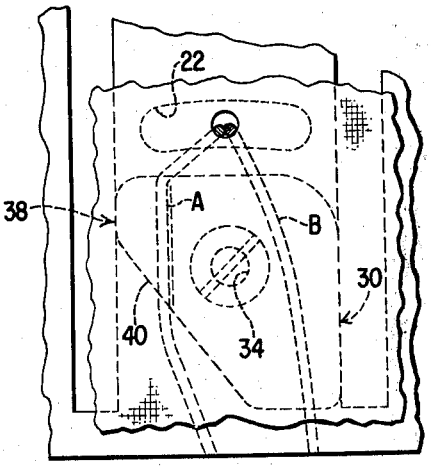
Fig. 5

ANTI-HALOING THROAT PLATE

This is a division, of application Ser. No. 940,935, filed Sept. 11, 1978.

BACKGROUND OF THE INVENTION

In the process of sewing, when the thread carrying needle of a sewing maching penetrates the work piece, a loop taker grasps and expands a loop of thread drawn from the needle. In most sewing machines, this loop of thread is released by the loop taker, allowing the loop complete freedom of motion as the thread take-up, in tightening the stitch, draws the take-up limb of the thread loop up through the work piece. Occasionally, as the take-up limb of the thread loop is being drawn up through the work piece, due to friction between the take-up limb and the work limb, the work limb is also drawn up above the surface of the work piece where it may be trapped, forming a loose thread loop commonly called a halo.

U.S. Pat. No. 4,095,539 of R. E. Johnson, discloses a needle thread work limb retaining finger for separating the work limb from the take-up limb in a loop of thread to aid in the prevention of haloing. The use of this finger, however, significantly increases the thread demand since, during expansion and manipulation of the thread loop by the loop taker, the work limb must be draped over the finger which lies outside the normal path of the thread. This increased thread demand necessitates redesign of the thread take-up. In addition, after loop cast-off by the loop taker, the finger provides no position restraint on the work limb, and, considering the distance between the finger and the needle hole, through which both the work limb and the take-up limb must pass, the work limb and the take-up limb may still interengage possibly resulting in the work limb being frictionally drawn up with the take-up limb and being caught, forming a halo.

SUMMARY OF THE INVENTION

The object of this invention is to provide means both for separating the work limb from the take-up limb of a loop of thread and for positively restraining the work limb to prevent inadvertent haloing. This object is achieved in one embodiment of this invention by affixing to the underside of the throat plate a block having a friction slot therein. The block is so positioned on the throat plate that the work limb of a loop of thread will naturally be caught in the slot as the loop taker expands the loop of thread without the work limb deviating significantly from its normal thread path. Another embodiment of this invention achieves the same capture and restraint of the work limb with a network of bristles lying parallel to the throat plate and fastened thereto. Still another embodiment employs a flat resilient spring finger which is fastened beneath the throat plate and which engages and restrains the work limb.

DESCRIPTION OF THE DRAWING

With the above and additional objects in view as will hereinafter appear, this invention will be described with reference to the accompanying drawings of three preferred embodiments in which:

FIG. 1 is a bottom view of one embodiment of this invention, showing a block attached to the throat plate;

FIG. 2 is an edge view of the embodiment of FIG. 1 showing the friction slot in the block;

FIG. 3 is a perspective view of a loop of thread having been expanded by the loop taker, the work limb thereof being held in the friction slot of the preferred embodiment of FIG. 1;

FIG. 4 is a perspective view as in FIG. 3 in which the loop of thread is being withdrawn by the retraction of the take-up limb of the thread loop;

FIG. 5 is an enlarged top plan view of the thread engaging block of the embodiment of this invention illustrated in FIGS. 1 and 4 showing the paths of the two limbs of a thread loop as they emerge from a needle hole in the work piece;

FIG. 6 is an enlarged edge plan view of the thread engaging block of the embodiment of FIG. 1;

DESCRIPTION OF THE PREFERRED EMBODIMENT

Figure 7:
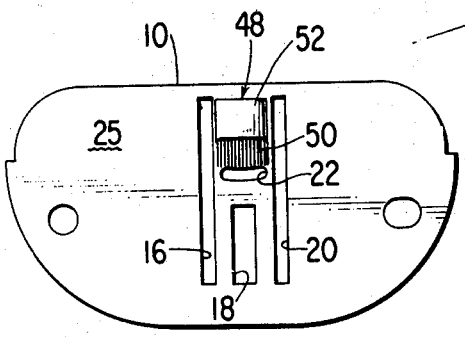
FIG. 7 is a bottom view of a throat plate having one alternate embodiment of this invention attached thereto.

With reference to FIGS. 1 and 2, one preferred embodiment of an anit-haloing device is shown associated with a throat plate 10. The throat plate 10 is formed with a round hole 12 at one end and an elongated hole 14 at the other end for mounting the throat plate 10 to the bed of a sewing machine (not shown). The throat plate 10 is also formed with three laterally elongated parallel feed apertures 16, 18 and 20, located near the center thereof for the purpose of accommodating a sewing machine feed dog (not shown). The outer feed apertures 16 and 20 are equidistant and extend substantially across the full width of the throat plate 10. The middle slot 18 extends from the rear edge of the throat plate 10 to a point midway of the throat plate 10. In front of said middle slot 18 is formed an arcuate needle aperture 22 for accommodating the lateral jogging of a needle, for example needle 24, in a zig zag sewing machine.

The throat plate 10 overlies a portion of a loop taker H which is carried on a vertical shaft (not shown) having a vertical axis disposed in front of the needle 24 as seen from the direction of material feed. The loop taker has a beak 23 which rotates in a horizontal path, the throat plate 10 being located in a plane parallel to the path of the loop taker beak 23.

The underside 25 of the throat plate 10 in front of the needle aperture 22 is formed with a recessed area 26 in which is mounted a tension block 30. The tension block 30 is formed with a flat mounting surface 32. A hole 34 is formed in the tension block 30, intersecting the mounting surface 32, through which a screw 36 passes securing the tension block 30 to the throat plate 10. Also formed in the tension block 30 on a plane parallel to the mounting surface 32 is a slot 38 extending across one side 40 of the tension block 30 in the same direction as the three feed apertures 16, 18 and 20. The slot 38 is so positioned on the tension block 30 that, when the tension block 30 is mounted to the throat plate 10, one wall 42 of the slot 38 will be coplanar with the underside 25 of the throat plate 10 and the other wall 44 of the slot 38 will be disposed beneath the underside 25 of the throat plate 10 such that the slot 38 is exposed immediately beneath the underside 25 of the throat plate 10. The slot 38 is of such a size as will freely accommodate the largest size thread capable of being used with the particular sewing machine. The requisite friction is effected through the mere passage of the thread between and over the relatively expansive surfaces of the parallel extending walls, 42 and 44, of the slot 38; the rubbing of the thread thereagainst causing a sufficient amount of friction on the thread as will provide restraining means effective on thread therein to counteract friction between the work limb A and the take-up limb B as well as inhibiting tendency of the work limb A to move out of slot 38. The passage of the work limb A into the slot 38 results in a cantilevered segment 39 of the block being interposed between the work limb A and the take-up limb B.

The side 40 of the tension block 30, in which slot 38 is formed, tapers toward the opposite side of the tension block 30 in a direction away from the needle aperture 22. The tapering of side 40 along with the sloping of surface 46, opposite the mounting surface 32, combine to assure a smooth, snag-free surface over which the loop of thread may traverse.

Referring to FIGS. 3, 4 and 5, one may see that the tension block 30 should be in close proximity of the needle aperture 22, preferrably in advance of the needle aperture in the path of material feed, to provide means for effecting maximum separation of the thread loop separation and to provide for the largest possible period of time during which the work limb A of the thread loop may be restrained. In addition, the positioning of the block 30 and the location of the slot 38 therein are dependent upon the position and direction of movement of the beak 23 of the loop taker which seizes and expands the loop of thread. As shown in FIG. 3, the slot 38 opens in the direction of movement of the beak 23 of loop taker H such that the expansion of a loop of thread by the loop taker will cause the work limb A of that loop to naturally pass into the slot 38, which, in turn, retains the same therein.

In operation, referring to FIG. 3, a loop of thread has been grasped and expanded by loop taker H into two portions; the work limb A, and the take-up limb B. As can be seen in FIG. 3, the work limb A is restrained by slot 38 and held away from the take-up limb B after the loop of thread has been released by or cast-off the loop taker H. In FIG. 4, work limb A is held in slot 38, with the cantilevered segment 39 interposed between the work limb A and take-up limb B, until it is pulled therefrom directly by take-up limb B in the proper formation of a stitch.

Referring to FIG. 7, the throat plate 10 is shown having an alternate embodiment of an anti-haloing device shown generally at 48. The anti-haloing device 48 comprises a plurality of bristles 50 which lie parallel to the feed apertures 16, 18 and 20 and parallel to the throat plate 10 and which are formed from a resilient material as for example, a polyester compound. Preferably, the bristles are atached to the throat plate 10 by a holder 52 which restrains the bristles 50 in close parallel proximity to each other and which is fastened to the throat plate 10 in any conventional manner, as for example with cement. The bristles lie in advance of the needle aperature 22 with their free extremity adjacent thereto so that as the loop of thread is expanded the work limb thereof will be ensnared in the bristles. It is to be understood that the individual bristles 50 lie in close proximity to each other so that when a work limb A of thread is trapped therein, the bristles 50 will frictionally restrain the work limb A, thereby preventing the formation of a halo during the setting of the stitch.

Figure 8:
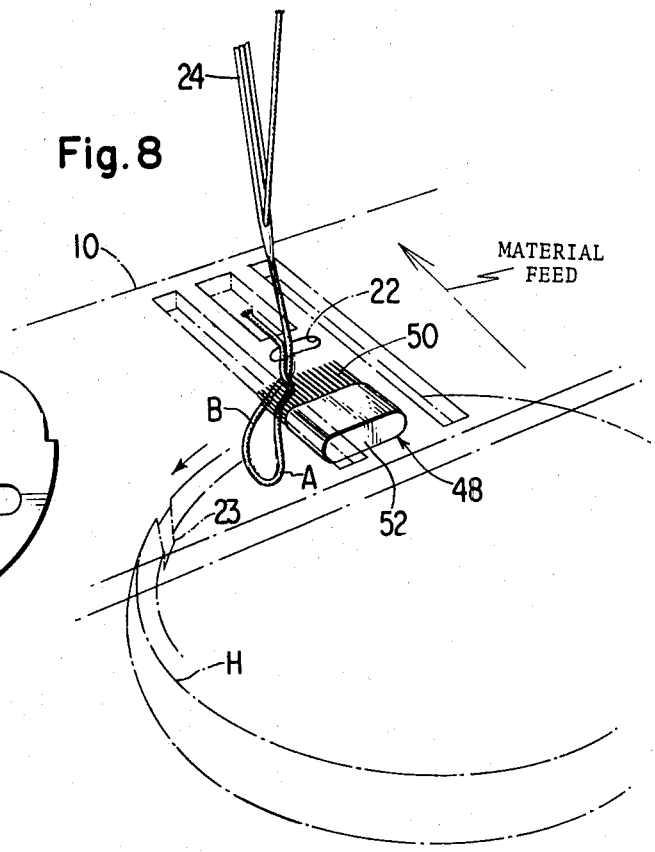
FIG. 8 is a perspective view (similar to FIG. 3) showing how the alternate embodiment of the anti-haloing throat plate shown in FIG. 7 restrains the work limb of needle thread in a network of bristles.
Figure 11:
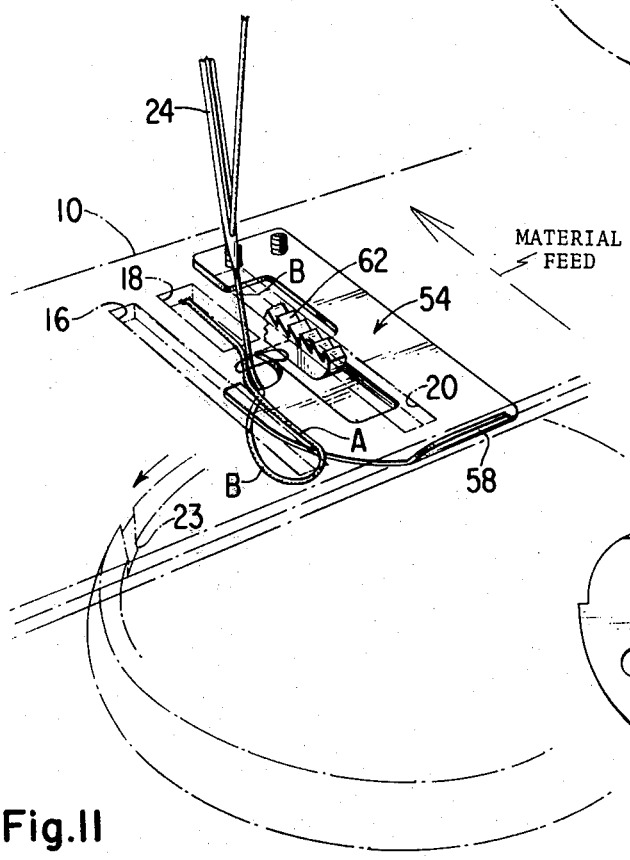
FIG. 11 is a perspective view in which the anti-haloing throat plate of FIG. 9 is shown cooperating with the work limb of needle thread to prevent the formation of halos.

FIG. 8 best illustrates how the anti-haloing device 48 cooperates with the work limb A of thread to prevent the formation of a halo. The loop of thread, consisting of the work limb A and the take-up limb B, is restrained on the loop taker H until it is cast off. During the rotation of the loop taker H the work limb A is restrained on the top of the loop taker H and the take-up limb B is below the loop taker H. It will be appreciated that owing to the positioning of the bristles 50 with respect to the loop taker H the work limb A will be drawn into the bristles 50 while the loop is being expanded by the loop taker H and will remain there after cast off of the loop by the loop taker H. An inspection of FIG. 8 will reveal that the work limb A is restrained within the bristles 50, held away from the take-up limb B, and maintained separate from the take-up limb until it is pulled therefrom by the take-up limb B being drawn upward through the material during the proper formation of a stitch. The work limb A is thereby restrained from interengagement with the take-up limb B until the time when the work limb is drawn up against the work piece by the take-up limb.

Figure 10:
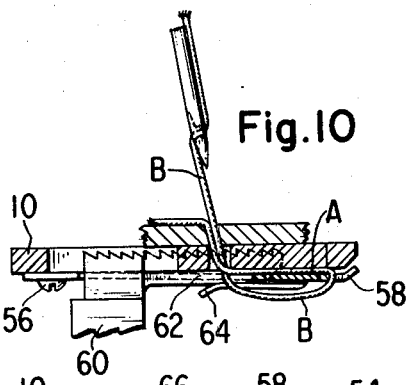
FIG. 10 is a side view showing the alternative embodiment of FIG. 9 and illustrating how the feed dog cooperates with the resilient plate to open a slot for accommodating the work limb of thread.
Figure 9:
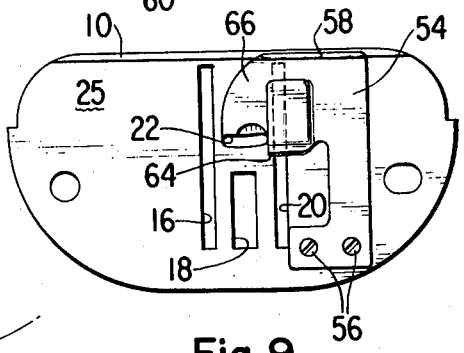
FIG. 9 is a bottom view of a throat plate having another alternative embodiment applied thereto in which a thread restraining finger is fastened beneath the throat plate.

FIG. 9 shows a second alternate embodiment of an anti-haloing device which is shown generally at 54, attached to the throat plate 10. The anti-haloing device 54 comprises a resilient plate or member which is fastened to the bottom of the throat plate in any conventional manner, as for example with a set of fasteners 56. Preferably the anti-haloing device 54 is manufactured from a spring steel or similar material, which will return to its original position after a deflecting force is removed therefrom. The device has a protrusion 58 which may be engaged by a sewing machine operator's finger to deflect the device 54 away from contact with the throat plate 10. The anti-haloing device 54 is intended to cooperate with a feed dog 60 shown in FIG. 10, which is shown having a segment 62 thereof residing in the feed aperture 20. The device 54 has a downturned tab 64 which may preferably be employed to aid in interposing the feed dog segment 62 between the anti-haloing device 54 and the throat plate 10. The anti-haloing device 54 is also shown having a thread restraining finger 66 situtated in front of the needle aperture 22, which traps and restrains the work limb A of thread until it is drawn up against the material being sewn by the take-up limb B. It will be appreciated from a review of FIG. 10 that the restraining finger 66 is so located to reciprocate in a well known manner with the rising and falling component of motion of the feed dog 60. The restraining finger 66 is thereby urged away from the throat plate 10 by the falling motion of the feed dog segment 62, and in so doing creates a passageway or space to accommodate the work limb A of the needle thread loop therebetween.

In operation, the thread restraining finger is moved downwardly to present the passageway or space for the entrance of the work limb A just before the beak 23 of the loop taker seizes the loop of thread which is shed from the needle 24 in a well known manner. The work limb A is thereafter drawn into the passageway or space formed between the thread restraining finger 66 and the throat plate 10 by the rotation of the loop taker. As the loop taker 10 continues to rotate, the feed dog 60 moves upwardly, thereby closing the passageway between the thread restraining finger 66 and the throat plate 10. When the loop of thread is cast off by the loop taker 10 in a process that is well known in the art of sewing, the thread restraining finger 66 is closed against the throat plate 10, thereby restraining the work limb A therebetween. A frictional drag is thereby imposed on the work limb A by the thread restraining finger 66 and the throat plate 10, thus preventing the interengagement of the work limb A with the take-up limb B and thereby preventing the formation of halos.

Numerous alterations of the structures herein disclosed will suggest themselves to those skilled in the art. However, it is to be understood that the present disclosure relates to three preferred embodiments of the invention which are for purposes of illustration only and not to be construed as a limitation of the invention. All such modifications which do not depart from the spirit of the invention are intended to be included within the scope of the appended claims.

I claim:

1. In a sewing machine having a bed, a reciprocatory thread carrying needle and a loop taker located in the bed of said sewing machine for grasping and expanding a loop of thread forming a work limb and a take-up limb as said needle penetrates the material being sewn, an anti-haloing device comprising a throat plate having an aperture formed therein through which said needle traverses, and means on said throat plate for separating said work limb from said take-up limb of said loop of thread and for positively restraining said work limb thereby preventing said work limb from being prematurely drawn through the material being sewn due to friction with said take-up limb, wherein said means comprises a plurality of closely spaced bristles lying parallel to said throat plate and in advance of said needle aperture, said bristles being in such a position as when said loop taker captures and expands said loop of thread, the work limb thereof will be ensnared in said bristles, and will be frictionally retained during cast-off of said loop of said loop taker until the take-up limb is drawn through said aperture through which said needle traverses.

2. An anti-haloing device as set forth in claim 1 wherein said plurality of bristles are restrained in close parallel proximity one to another by a holder, said holder leaving a free extremity of said bristles available for ensnaring said work limb of thread.

3. An anti-haloing device as set forth in claim 2 wherein said holder is fastened to said throat plate in advance of said needle aperture.

* * * * *